US007234721B2

(12) United States Patent
DeRocco

(10) Patent No.: US 7,234,721 B2
(45) **Date of Patent: *Jun. 26, 2007**

(54) SNOWBOARD WITH PARTIAL SIDEWALL

(75) Inventor: Anthony O DeRocco, Seattle, WA (US)

(73) Assignee: K-2 Corporation, Vashon, WA (US)

( * ) Notice: Subject to any disclaimer, the term of this patent is extended or adjusted under 35 U.S.C. 154(b) by 67 days.

This patent is subject to a terminal disclaimer.

(21) Appl. No.: 11/026,513

(22) Filed: Dec. 30, 2004

(65) Prior Publication Data

US 2005/0161910 A1 Jul. 28, 2005

Related U.S. Application Data

(63) Continuation of application No. 10/116,468, filed on Apr. 3, 2002, now Pat. No. 6,851,699, which is a continuation of application No. 09/639,863, filed on Aug. 16, 2000, now abandoned.

(51) Int. Cl.
*A63C 5/048* (2006.01)

(52) U.S. Cl. ..... 280/608; 280/602

(58) Field of Classification Search ..... 280/601, 280/602, 607, 608, 609, 610, 14.21, 14.22
See application file for complete search history.

(56) References Cited

U.S. PATENT DOCUMENTS

| | | | | |
|---|---|---|---|---|
| 3,940,157 A | | 2/1976 | Sakuma | |
| 4,556,237 A | | 12/1985 | Meatto et al. | |
| 5,288,097 A | | 2/1994 | Pascal et al. | |
| 5,292,148 A | | 3/1994 | Abondance et al. | |
| 5,496,053 A | | 3/1996 | Abondance | |
| 5,553,884 A | | 9/1996 | Abondance | |
| 5,599,036 A | | 2/1997 | Abondance et al. | |
| 5,678,841 A | | 10/1997 | Bauvois | |
| 5,690,349 A | * | 11/1997 | Rohrmoser | 280/610 |
| 5,769,445 A | | 6/1998 | Morrow | |
| 5,782,482 A | | 7/1998 | Andrus et al. | |
| 5,988,668 A | * | 11/1999 | DeVille et al. | 280/602 |
| RE36,453 E | | 12/1999 | Abondance et al. | |
| RE36,586 E | | 2/2000 | Abondance et al. | |

(Continued)

FOREIGN PATENT DOCUMENTS

EP 0 620 027 B1 10/1994

(Continued)

*Primary Examiner*—Frank Vanaman
(74) *Attorney, Agent, or Firm*—Christensen O'Connor Johnson Kindness PLLC

(57) ABSTRACT

A snowboard (10) includes a central section (12) and tip and tail sections (14, 16). The snowboard includes a core (30) bordered within the central section along longitudinal edges by sidewall members (24). The snowboard includes upper and lower reinforcement layers (32, 34) covered by a top sheet (36) and a base (38). The outer surfaces (44) of the sidewall members (24) are exposed between the top sheet and the base within the central section of the board. In the tip and tail section of the board, the sidewall members are absent, with a cap formed by the top sheet and upper reinforcement layer extending to cover the perimeter edge of the core and join to the base. The board thus has a fully exposed sidewall construction in the central section and a capped construction in the tip and tail sections.

25 Claims, 2 Drawing Sheets

U.S. PATENT DOCUMENTS

| | | | | |
|---|---|---|---|---|
| 6,073,954 | A | 6/2000 | Guiguet et al. | |
| 6,105,991 | A | 8/2000 | Dodge et al. | |
| 6,113,126 | A | 9/2000 | Zanco et al. | |
| 6,193,244 | B1 | 2/2001 | Vance | |
| 6,357,781 | B1 | 3/2002 | Jeandin | |
| 6,406,054 | B1 | 6/2002 | Huyghe | |
| 6,481,741 | B1 | 11/2002 | Porte | |
| 6,502,850 | B1 | 1/2003 | Schaller et al. | |
| 6,520,530 | B1 * | 2/2003 | Dodge et al. | 280/610 |
| 2003/0234513 | A1 | 12/2003 | Zanco | |

FOREIGN PATENT DOCUMENTS

| | | | |
|---|---|---|---|
| EP | 0 620 028 | A1 | 10/1994 |
| EP | 0 723 791 | A1 | 7/1996 |
| EP | 1 004 335 | A2 | 5/2000 |
| FR | 1448596 | | 6/1966 |
| FR | 2739299 | * | 4/1997 |
| FR | 2 802 438 | A1 | 6/2001 |

* cited by examiner

SNOWBOARD WITH PARTIAL SIDEWALL

CROSS-REFERENCE TO RELATED APPLICATIONS

This application is a continuation of application Ser. No. 10/116,468, filed Apr. 3, 2002, which is a continuation of application Ser. No. 09/639,863, filed Aug. 16, 2000 now abandoned, the disclosure of which is hereby expressly incorporated by reference.

FIELD OF THE INVENTION

The present invention relates to glide boards for riding on snow, particularly to snowboards and skis having longitudinally edges formed partially from a sidewall member.

BACKGROUND OF THE INVENTION

Traditional snowboard construction involves laminating a core, usually wooden, and reinforcement layers between a top sheet and a base. The perimeter edge of the core is protected by a vertical sidewall, formed of a durable, substantially rigid yet resilient polymeric material, that borders the edge of the core and is sandwiched between the top sheet and base. Such a conventional full sidewall board has a visible vertical sidewall formed about the entire perimeter of the board. Full sidewall boards perform well and have a solid feel for the rider when working the edges of the board, but increases the weight of the board significantly.

In recent years, full sidewall snowboard construction has given way in many instances to construction of snowboards including an upper cap. In a capped snowboard construction, the core of the snowboard is tapered along the perimeter edge. The top sheet and upper reinforcement layer of the snowboard form a cap that extends downwardly over the tapered edge to join the metal reinforced base of the snowboard. No separate sidewall member is included to border the core, which instead has a tapered appearance all about its edge thin at the junction between the cap and base. Capped snowboards are lighter in weight and preferred by some riders because the tip of the board allows a deeper arc to be curved into the snow during carving of turns. However, impact on the edges of a capped board are transmitted directly to the reinforcement structure of the board, as contrasted to a full sidewall board in which some of the impact is absorbed and dissipated by the sidewall member. While an aerodynamic appearing, capped construction is preferred by many riders, other riders prefer the more solid feel of a full sidewall laminate board.

SUMMARY OF THE INVENTION

The present invention provides a snowboard including a partial sidewall and a partial capped construction. The snowboard includes a core that is reinforced by one or more reinforcing layers. The core defines a perimeter edge, and includes a central section disposed between a forward tip section and a rearward tail section. The perimeter edge includes two longitudinal edge portions bordering the central section. First and second sidewall members are disposed on either side of the core along the longitudinal edge portions of the central section of the board. The board further includes a top sheet overlying the upper surface of the reinforced core and a base underlying a lower surface of the reinforced core. The top sheet tapers over the edge of the core, to meet the base, in the tip and tail sections of the board, forming a cap in these sections. The outer surface of the sidewall members are exposed between the top sheet and base along the longitudinal edge portions of the central section of the board, with the height of the exposed outer surface of the sidewall being substantially equal to the major thickness of the core.

The present invention provides a hybrid snowboard construction, including the solid feel and force dissipation of a fully exposed sidewall along the longitudinal edges of the central running surface of the board, and an aerodynamic, tapered, deep carving capped construction in the tip and tail of the board.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
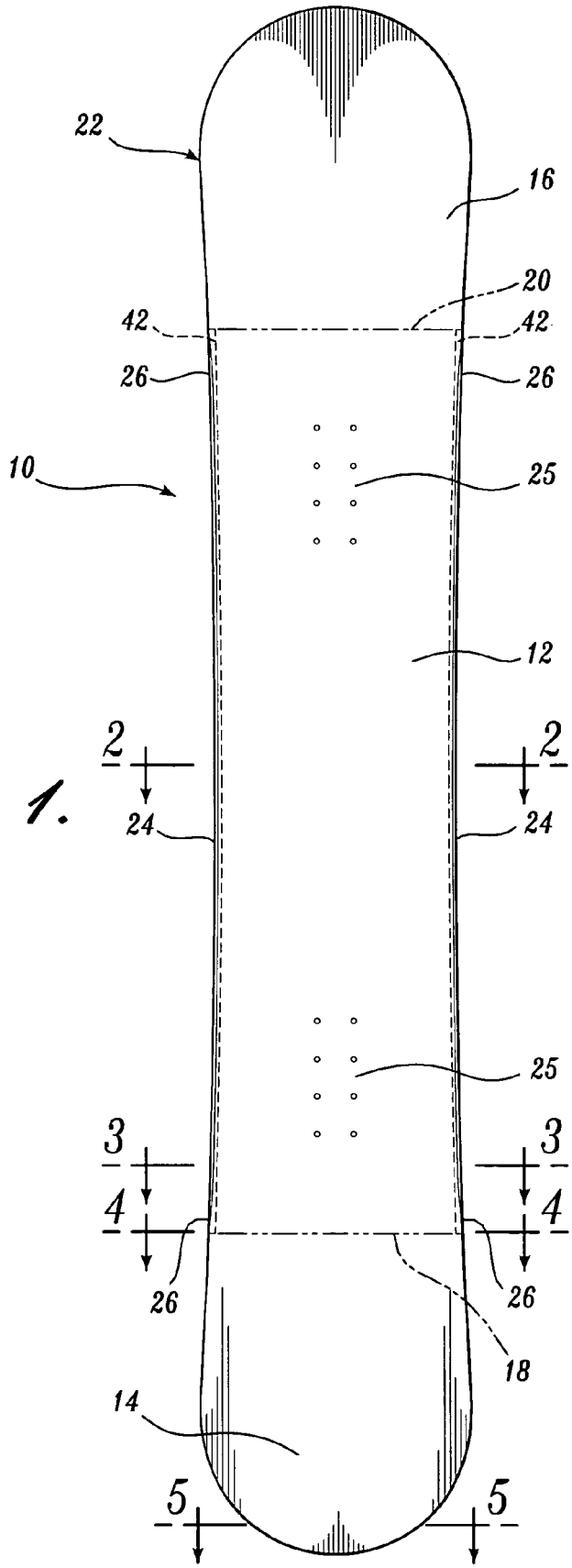
FIG. 1 provides a top plan view of a snowboard constructed in accordance with the present invention.

A snowboard 10 constructed in accordance with the present invention is illustrated in FIG. 1. The snowboard 10 includes a central section 12 bordered by a forward tip section 14 and an aft tail section 16. As used herein the term "forward" refers to the direction along the longitudinal axis of the board, toward the tip section 14, while the terms "aft" and "rearward" refer to the direction along the longitudinal axis of the board towards the tail section 16. The lower surface of the board 10 defines a forward contact point 18 and aft contact point 20, which correspond to transverse lines defined across the board at the juncture of the central section 12 with the tip and tail sections 14, 16 respectively. The forward and aft contact points 18, 20 are the outboard most contact points of the lower surface of the board with a flat surface on which it rests, with the board curving upwardly therefrom towards the tip and tail, respectively, as is known for conventional snowboard construction.

The snowboard 10 includes a perimeter edge 22. Longitudinal portions of the perimeter edge 22 are defined along either side of the central section 12 of the board, and are reinforced by first and second sidewall members 24. The left and right sides of the board 10, and the sidewall members 24 on the left and right sides, are similarly constructed and mounted. Thus, only a single side of the board will be described, with it being understood that the opposite side of the board is constructed similarly.

As can be seen in FIG. 1, each sidewall member 24 extends from the forward contact point 18 to the aft contact point 20, along the longitudinal edges of the central section 12. While this illustrated degree of extension is preferred, the sidewall members 24 could be of alternate length so long as they extend along the binding region 25 of the central section 12 of the board, to which snowboard bindings are secured to receive and mount the rider's feet. Thus, the sidewall members may not extend fully to the forward and aft contact points 18, 20, or may extend slightly past the contact points 18, 20. Preferably, the sidewall members terminate shortly before the forward and aft contact points, such as 5–10 cm before the contact points. This enables a torsion box construction in the tip and tail, as described further below.

The sidewall members 24 are preferably formed from a relatively rigid material that has a predetermined degree of resiliency. Suitable materials include polymers such as acrylonitrile-butadiene-styrene (ABS) resin, ABS/polyurethane blends, phenolic composites and the like.

The sidewall members 24 do not extend around the forward edge of the tip section 14 or the rearward edge of the tail section 16. Rather, the forward and rearward edges and curved transitions of the tip section 14 and tail section 16 are absent, (i.e., devoid of), a sidewall member, instead having a tapered, capped construction. The sidewall construction of the central section 12 provided by the sidewall members 24 transitions to the tapered capped construction of the tip and tail sections 14, 16 at transition zones 26 defined along a relatively short length at opposing ends of each sidewall member 24. The transition zones 26 are located just inwardly of the forward contact point 18 and aft contact point 20 at each end of the sidewall members 24. By way of nonlimiting example, a 155 cm long board may suitably include sidewall members 90 cm in length, spanning 60% of the length of the board, with each end of the sidewall member transitioning from an exposed sidewall to a capped construction over a 5 cm long transition zone (or alternate sidewall transition location).

Attention is now directed to FIGS. 2–5 to describe the internal construction of the snowboard 10. The snowboard 10 includes a core 30, preferably constructed of wood, syntactic polyurethane foam or other known core materials. The core 30 extends the full width of the snowboard except for the width of the sidewall members 24, and is tapered along its edge in the tip and tail sections 14, 16. The core has a rectangular cross section in the central section 12, though other configurations, such as a three-dimensionally contoured core, are possible.

The core is reinforced by upper and lower reinforcement layers 32, 34, which layer the upper and lower surfaces of the core 30. The upper and lower reinforcement layers 32, 34 are suitably constructed from a composite material such as glass fiber reinforced polyester resin, graphite or Kevlar reinforced resin, or metal sheeting, in one or more layers as may be required for a desired degree of rigidity of the board. Additionally, other internal reinforcement structures, such as torsional reinforcement structures (not shown), may be incorporated into the board.

The upper reinforcement layer 32 is preferably covered with a top sheet 36. The top sheet 36 is formed from a conventional top sheet material, such as a urethane, acrylic, Nylon™ polyamid, a polybutylene terephthalate or blends thereof. While incorporation of a top sheet is preferred, it is also possible to produce a board without a top sheet, in which the upper reinforcement layer integrally forms the cap. Specifically, a precured glass layer is provided and serves as the cap, with graphics (where used) being printed directly onto the precured glass.

The snowboard further includes a base 38 formed of a conventional durable low-friction material, such as ultra-high molecular weight polyethylene. Thus, in the preferred embodiment, the snowboard is constructed from top to bottom, from a top sheet 36, which overlies and is joined to an upper reinforcement layer 32, which overlies and is joined to the core 30, which overlies and is joined to the bottom reinforcement layer 34, which overlies and is joined to the base 38. The edge of the base 38 is reinforced, preferably along the full perimeter of the board, by a metal edge member 40, suitably constructed of steel, as is well-known in the art. The metal edge member 40 is preferably mounted by a flange that is received between the base 38 and lower reinforcement 34, to provide a sharp edge for cutting into the snow.

Figure 2:
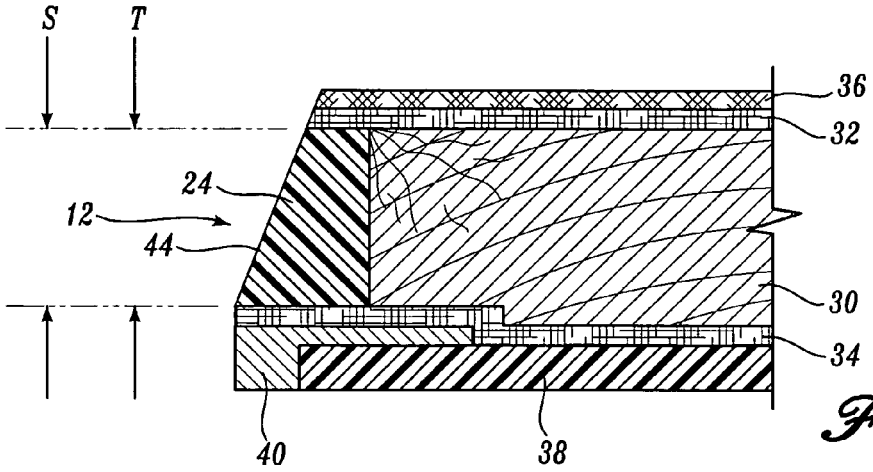
FIGS. 2, 3, 4 and 5 are transverse cross-sections taken through an edge region of the board of FIG. 1 along lines 2—2, 3—3, 4—4 and 5—5, respectively, corresponding to the central running surface, transition region, forward contact point and tip of the snowboard.

Attention is now directed to FIG. 2, which illustrates the mounting of the sidewall members 24 along the edge of the central section 12 of the board 10. The lower surface of the central section 12 of the board provides the running surface for the snowboard. The core 30 has a substantially rectangular configuration in this section. The core 30 defines a height or thickness T, which is substantially consistent along the majority of the core within the central section 12. Each sidewall member 24 is adhered, such as by the use of an adhesive or by resin used in the upper reinforcement layer 32, to the outer perimeter edge of the core 30. A longitudinal recess 42 (FIG. 1) is formed into the longitudinal portions of the perimeter edge 22 along the central section 12 to accommodate the sidewall members 24. In this section of the board, the sidewall member 24 defines a height S which is the same as, i.e., substantially equal to, the thickness T of the core 30.

The sidewall member 24 defines a generally vertical outer surface 44 that is fully exposed between the cap formed by the top sheet 36 and upper reinforcement layer 32 on the upper surface thereof, and the base 38 and lower reinforcement layer 34 on the lower surface thereof. Thus, the outer surface 44 of the sidewall member 24 is not covered by, and is free of, the top sheet 36, base 38 and reinforcement layers 32, 34. As such, the full height of the outer surface 44 of the sidewall member 24 is exposed and visible, and comes in contact with snow and ice to absorb and dissipate energy during riding and carving. In the preferred embodiment illustrated, the outer surface 44 of the sidewall member 24 is inclined slightly upwardly, such as by 2%. However, this generally vertical inclined outer surface 44 could instead have a greater or lesser degree, or no degree, of inclination. The upper and lower surfaces of the sidewall member 24 are illustrated in the preferred embodiment as being layered by the upper reinforcement layer 32 and lower reinforcement layer 34. While such construction is preferred to firmly secure the sidewall member 24 to the core 30, alternately the reinforcement layers may stop at the edges of the core 30.

Figure 3:
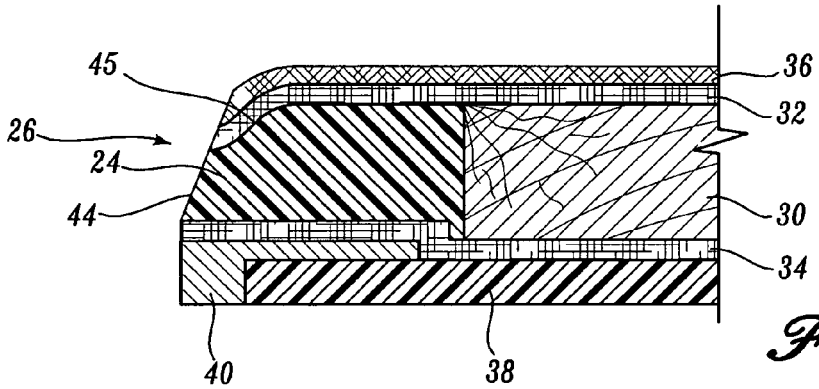

Attention is now directed to FIG. 3, which illustrates the edge of the snowboard 10 within one of the short transition zones 26. In this zone, the outer upper portion 45 of the outer surface 44 of the sidewall member 24 is chamfered, so as to accommodate an overlap of the upper reinforcement layer 32 and top sheet 36 while presenting a tapered outer contour. The cap formed by the upper reinforcement 32 and top sheet 36 thus wraps a portion of the outer surface 44 of the sidewall 24 with a portion of the outer surface 44 remaining exposed. The degree of wrapping of the outer surface 44 transitions gradually from 0% at the start of the transition zone 26 to 100% at the forward contact point 18 (or alternate location of termination of sidewall members).

Figure 4:
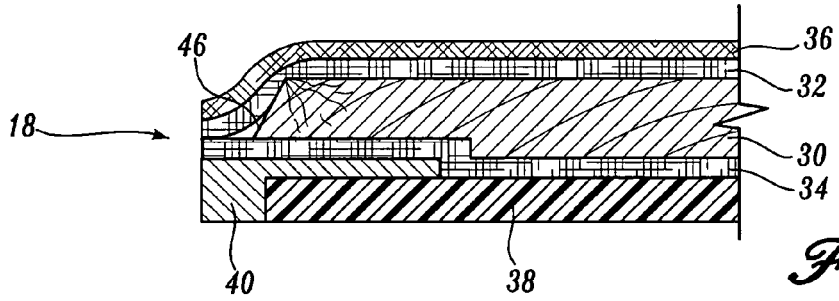

Attention is next directed to FIG. 4, which illustrates the edge of the snowboard 10 at the forward contact point 18, and which is also representative of the aft contact point 20. At this point, the sidewall member 24 has terminated, and the top sheet 36 and upper reinforcement layer 32 extend downwardly to fully wrap a tapered outer edge 46 of the core 30. Thus, in the tip and tail sections, the board has a torsion box construction, with the upper reinforcement layer wrapping the core and joining the lower reinforcement layer to completely surround the core. The core 30 is reduced in thickness relative to the center of the board as the board tapers towards the tip and tail. The cap formed by the top sheet 36 and upper reinforcement layer 32 thus tapers downwardly to join the bottom reinforcement layer 34 at the outermost edge of the board 10. In this location, the board thus has a capped construction.

The preferred embodiment has been illustrated as transitioning from the fully exposed sidewall member 24 of FIG. 2, in the central section 12 of the board, to the fully capped construction of FIG. 4 at the forward and aft contact points 18 and 20, over the short transition zones 26 of FIG. 3. In the short transition zones 26, the degree of coverage of the outer surface 44 of the sidewall member 24 gradually increases, until the sidewall member 24 terminates at or just before the contact points. The sidewall members 24 may also taper in width over the short transition zone 26, and still alternately the transition from the fully exposed outer surface of the sidewall member 24 of FIG. 2 to the fully capped construction of FIG. 4 may occur abruptly rather than over the short transition zone illustrated.

Figure 5:
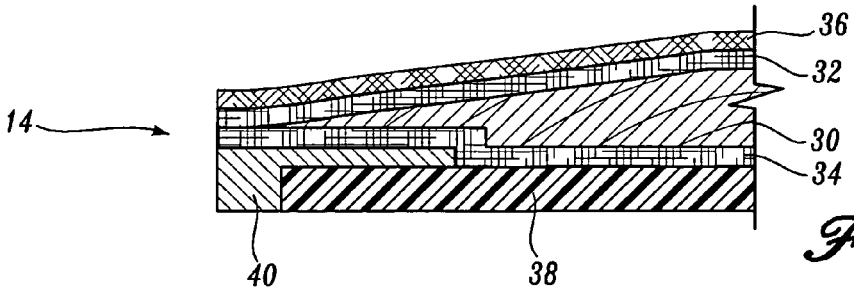

FIG. 5 illustrates the construction of the snowboard along the edge at the tip section 14, with it being understood that the tail section 16 is similar. Construction at the tip section 14 in FIG. 5 is similar to that at the contact points 18, 20 as shown in FIG. 4, except that the core 30 decreases further in thickness towards the edge of the tip and tail. Again, the cap defined by the top sheet 36 and upper reinforcement layer 32 wraps to join the lower reinforcement layer 34, with no sidewall member being present.

Thus the present invention provides a snowboard that has a fully exposed sidewall along the central section or running surface of the board, which provides a solid feel to the user and which absorbs and dissipates energy. The tips and tails of the snowboard in contrast have a tapered, capped construction, the sidewall member not being present, for an improved appearance, reduced weight and deep carving ability.

The tip and tail sections of the board are provided with a full torsion box construction, with a reinforced box surrounding the core on all sides, and the reinforcing layers carrying load for increased torsional rigidity. This yields quickness and responsiveness edge to edge in the tip and tail. Input forces are driven effectively into the ground, for quick energy responsiveness and efficient use of turning forces. In contrast, in the central region of the board, a laminate sidewall construction is provided, in which the upper and lower load carrying reinforcement layers do not touch and are not present in the vertical axis of the sidewalls. This construction is more highly dampened and not as responsive, deadening and quieting the loads under foot. The central region thus helps insulate the rider from harsh riding effects, for comfort and stability.

In the central section of the board 10, the sidewall members 24 are exposed between the cap formed by the top sheet 36 and upper reinforcement layer 32, and the lower reinforcement layer 34. As such, the exposed outer surface 44 extends the full height or thickness of the core 30, which is substantially the full height or thickness of the board 10 as defined between a plane defined by the lower surface of the base 38 and a plane defined by the majority of the upper surface of the top sheet 36. It should be understood that reinforcement members may be inserted into a snowboard below the top sheet 36, such as longitudinal or torsional reinforcements, which will project upwardly above the plane defined by the majority of the upper surface of the snowboard 10.

While the present invention has been described in terms of a snowboard 10, it should be apparent to those of skill in the art that the present invention, including a combination of a fully exposed sidewall along at least a longitudinal portion of the central section and a capped construction at a forward shovel end and at a rearward tail end could be incorporated into a snow ski or ski board.

The snowboard 10 can be suitably manufactured by several methods. In a first preferred method, a block of material, such as wood, used to form the core 30 is formed and shaped. An elongate longitudinal recess 42 is then cut into each side of the core material to form a longitudinal recess 42 that will receive a sidewall member 24. This block of core material is then sliced along horizontal planes to form individual core members, each of which includes two longitudinal recesses to receive sidewall members. Alternatively, individual core members 30 could first be cut, with longitudinal recesses 42 then being formed in each such core 30. When a foam core is used, the longitudinal recesses 42 may be formed in the core by molding.

Two rectangular elongate strips forming the sidewall members 24 are then adhered using an adhesive to the longitudinal edges of the core 30, within the side cut recesses provided therefor. The thusly-assembled core including sidewall members 24 can then be further shaped to define the desired profile and tip and tail configurations.

The snowboard is then completed using conventional molding techniques, by layering within a mold the base, then the bottom reinforcement layer 34, then the core 30 including the sidewall members 24 assembled thereto, then the top reinforcement layer 32, then the top sheet 36. The assembled layers are then molded between upper and lower mold halves, applying heat and pressure to shape and adhere the layers together in accordance with conventional molding techniques.

Alternately, rather than preassembling the sidewall members 24 to the core 30, the sidewall members 24 can be placed alongside the longitudinal edges of the core 30, within the side cut recesses provided therefor, and positioned between the upper and lower reinforcement layers 32, 34 and top sheet and base. This assemblage is then molded, with the resins used in the reinforcement layers 32, 34 adhering the sidewall members 24 to the core 30.

As a still further alternate, the core may be formed in place (when using a polymeric foam) between the surrounding sidewall members and reinforced base and top sheet within the mold.

Each sidewall member 24 in the preferred embodiment is a unitary, one-piece monolithic member. While this is preferred for durability, it should also be apparent that the sidewall members 24 could instead be formed from laminated layers. For example, the core may be constructed from a laminate including an elastomeric layer sandwiched between upper and lower core layers, and the sidewall member may likewise be formed of upper and lower sidewall layers that sandwich an elastomeric layer extending from the core.

While the preferred embodiment of the invention has been illustrated and described, it will be appreciated that various changes can be made therein without departing from the spirit and scope of the invention.

The invention claimed is:

1. A glide member for riding on snow, comprising:

a core defining a central section, tip and tail sections, and a perimeter edge, the perimeter edge defining first and second longitudinal portions along the central section of the core;

at least one reinforcement layer joined to the core;

a base disposed below the reinforced core; and first and second sidewall members joined to the longitudinal portions of the perimeter edge of the core along the central section of the core, the core defining a thickness within the central section extending from a lower surface of the core to an upper surface of the core, wherein the sidewall members each further define an outer surface that extends and is exposed over the defined thickness of the core between at least one reinforcement layer and base along the central section of the core, and wherein the reinforcement layer extends to cover the perimeter edge of the core along the tip and tail sections of the core;

wherein the core defines a forward contact point between the central section and the tip section and an aft contact point between the tail section and the central section, and the sidewall members extend between and terminate proximate to the forward and aft contact points, wherein the core further defines transition zones adjacent the forward contact point and aft contact point along each longitudinal portion of the perimeter edge, the outer surface of at least one of the sidewall members being fully exposed along the central section of the core between the transition zones and transitioning from being fully exposed to being substantially covered over the transition zones.

2. A glide member for riding on snow, comprising:

(a) a core defining:

(i) a central section;

(ii) tip and tail sections;

(iii) a perimeter edge defining a longitudinal portion along the central section;

(iv) a forward contact point between the central section and the tip section;

(v) an aft contact point between the tail section and the central section; and (vi) transition zones adjacent the forward contact point and the aft contact point along the longitudinal portion of the perimeter edge;

(b) at least one reinforcement layer joined to the core;

(c) a base disposed below the core; and (d) a sidewall member having an outer surface and an inner edge connected to the longitudinal portion, the sidewall member extending between and terminating proximate the forward and aft contact points, the outer surface of the sidewall member transitioning from being substantially fully exposed to being substantially covered over the transition zones.

3. The glide member of claim 2, wherein the outer surface of the sidewall member transitions gradually from being 0% covered to being 100% covered within the transition zones.

4. The glide member of claim 2, further comprising an edge member joined to the longitudinal portion of the core, the edge member having a length and a width, wherein the width of the edge member is less than a width of the sidewall member within at least the transition zones.

5. The glide member of claim 2, wherein the sidewall member has a varying width along its length.

6. The glide member of claim 2, wherein the inner edge of the sidewall member is non-linear between the forward and aft contact points.

7. The glide member of claim 2, wherein the reinforcement layer extends to substantially cover the perimeter edge of the core along a full length of the tip section forwardly of the forward contact point.

8. The glide member of claim 2, wherein the reinforcement layer extends to substantially cover the perimeter edge of the core along a full length of the tail section rearwardly of the aft contact point.

9. The glide member of claim 2, wherein the reinforcement layer extends to substantially cover the perimeter edge of the core along a full length of the tip section forwardly of the forward contact point and along a full length of the tail section rearwardly of the aft contact point.

10. The glide member of claim 2, wherein the substantially fully exposed outer surface of the sidewall is generally vertical.

11. The glide member of claim 2, further comprising upper and lower reinforcement layers joined to upper and lower surfaces of the core.

12. The glide member of claim 11, wherein the upper and lower reinforcement layers overlap upper and lower surfaces of the sidewall member, leaving the outer surface of the sidewall member exposed between the forward contact point and the aft contact point.

13. The glide member of claim 2, wherein the core defines a recess along the longitudinal portion of the central section of the core, in which the sidewall member is received.

14. The glide member of claim 2, wherein the sidewall member extends along substantially 60% of an overall length of the core.

15. The glide member of claim 2, wherein the outer surface of the sidewall member extends and is exposed entirely over a thickness of the core between at least one reinforcement layer and base along the central section of the core.

16. A glide member for riding on snow, comprising:

(a) a core defining:

(i) a central section;

(ii) tip and tail sections;

(iii) a perimeter edge defining a longitudinal portion along the central section of the core;

(iv) a forward contact point between the central section and the tip section;

(v) an aft contact point between the tail section and the central section;

(b) at least one reinforcement layer joined to the core and at least substantially covering the perimeter edge of the core in the tip and tail sections;

(c) a base disposed below the core;

(d) a sidewall member having an inner edge connected to the longitudinal portion, the sidewall member defining an outer surface that extends and is substantially exposed along the central section of the core; and (e) an edge member connected to the longitudinal portion of the core and defining a length and a width, the width of the edge member is less than a width of the sidewall member within at least a predetermined section of the core.

17. The glide member of claim 16, wherein the core further comprises transition zones adjacent the forward and aft contact points, the outer surface of the sidewall member transitioning from being substantially fully exposed to being substantially covered over the transition zones.

18. The glide member of claim 17, wherein the width of the edge member is less than the width of the sidewall member within the transition zones.

19. The glide member of claim 16, wherein the width of the sidewall member varies in a longitudinal direction of the core.

20. The glide member of claim 16, wherein the inner edge of the sidewall member is non-linear between the forward and aft contact points.

21. A glide member for riding on snow, comprising:

(a) a core having an outer edge thickness and further including:

(i) a central section;

(ii) tip and tail sections;

(iii) a perimeter edge defining a longitudinal portion along the central section of the core;

(iv) a forward contact point between the central section and the tip section;

(v) an aft contact point between the tail section and the central section;

(b) at least one reinforcement layer joined to the core and at least substantially covering the perimeter edge of the core in the tip and tail sections;

(c) a base disposed below the core;

(d) a sidewall member having an inner edge connected to the longitudinal portion, the sidewall member defining an outer surface, a length, and a width, wherein the width of the sidewall member extends between the outer surface and the inner edge and varies along the length of the sidewall member; and (e) an edge member connected to the longitudinal portion of the core and defining a length and a width, the width of the edge member is less than the width of the sidewall member within at least a predetermined section of the core.

22. The glide member of claim 21, wherein the outer surface of the sidewall member extends and is exposed over substantially the outer edge thickness of the core along the central section of the core.

23. The glide member of claim 21, wherein the core further comprises transition zones adjacent the forward and aft contact points.

24. The glide member of claim 23, the outer surface of the sidewall member transitioning from being substantially fully exposed to being substantially covered over the transition zones.

25. A glide member for riding on snow, comprising:

(a) a core having an outer edge thickness and further including:

(i) a central section;

(ii) tip and tail sections;

(iii) a perimeter edge defining a longitudinal portion along the central section of the core;

(iv) a forward contact point between the central section and the tip section;

(v) an aft contact point between the tail section and the central section;

(b) at least one reinforcement layer joined to the core and at least substantially covering the perimeter edge of the core in the tip and tail sections;

(c) a base disposed below the core; and (d) a sidewall member having an inner edge connected to the longitudinal portion, the sidewall member defining an outer surface, a length, and a width, wherein the width of the sidewall member extends between the outer surface and the inner edge and varies along the length of the sidewall member, wherein the core further comprises transition zones adjacent the forward and aft contact points, the outer surface of the sidewall member transitioning from being substantially fully exposed to being substantially covered over the transition zones.

* * * * *